United States Patent [19]

Yoshida et al.

[11] Patent Number: 4,665,275

[45] Date of Patent: May 12, 1987

[54] THERMAL MEDIUM OILS

[75] Inventors: Toshio Yoshida, Kawasaki; Harumichi Watanabe, Yokohama, both of Japan

[73] Assignee: Nippon Oil Co., Ltd., Tokyo, Japan

[21] Appl. No.: 745,576

[22] Filed: Jun. 17, 1985

[30] Foreign Application Priority Data

Jul. 5, 1984 [JP] Japan ..... 59-137886
Jul. 5, 1984 [JP] Japan ..... 59-137888
Nov. 28, 1984 [JP] Japan ..... 59-249772

[51] Int. Cl.[4] ..... C07C 13/47

[52] U.S. Cl. ..... 585/27; 585/26; 585/455; 585/456; 585/459; 585/6.6; 252/62; 252/73

[58] Field of Search ..... 252/73, 62; 585/26, 585/25, 24, 455, 456, 459, 6.6, 13, 27

[56] References Cited

U.S. PATENT DOCUMENTS

| | | | |
|---|---|---|---|
| 2,006,202 | 6/1935 | Huyser | 252/73 |
| 2,436,110 | 2/1948 | Larsen | 585/26 |
| 3,598,739 | 8/1971 | Sias | 585/26 |
| 3,678,123 | 5/1972 | Boggs | 585/467 |
| 4,521,324 | 6/1985 | Tsubouchi | 585/26 |

FOREIGN PATENT DOCUMENTS

| | | | |
|---|---|---|---|
| 2163774 | 3/1986 | United Kingdom | 585/26 |

OTHER PUBLICATIONS

Chemical Abstract, vol. 82:72654g, (1975).

*Primary Examiner*—Andrew H. Metz
*Assistant Examiner*—A. Pal
*Attorney, Agent, or Firm*—Bucknam and Archer

[57] ABSTRACT

A thermal medium oil comprising at least one monosubstituted naphthalene derivative such as $\beta$-(1,1-dimethyloctyl) naphthalene, $\beta$-(1,1-dimethylhexyl) naphthalene and 2-t.-amylnaphthalene.

2 Claims, No Drawings

THERMAL MEDIUM OILS

BACKGROUND OF THE INVENTION

1. Field of the Invention

This invention relates to a novel thermal medium oil and more particularly to a novel thermal medium oil having excellent oxidation stability and comprising at least one monosubstituted naphthalene derivative having a specific structure.

2. Prior Art

The recent technical progress in chemical industries is remarkable. In the heating system, an indirect heating system using an oil or the like as a thermal medium has been substituted for a conventional direct heating system and is now widely used in all the fields of industries such as fiber, paper making, foodstuff, architectural and chemical industries.

A heat or thermal medium oil has most generally been used as the thermal medium for the indirect heating system and is usually required to be such that:

(1) It is excellent in oxidation stability, (2) It has a low vapor pressure and a high flash point, (3) It has satisfactory fluidity even at low temperatures, (4) It has no toxicity and no odor, and (5) It has good heating efficiency.

At the present, there are widely used not only a highly refined mineral oil incorporated with an antioxidant, but also a phenyl ether, a polyphenyl, an arylalkane and an alkylnaphthalene having methyl, ethyl, propyl or the like group, and the like.

Of these known thermal medium oils, the alkylnaphthalene-based ones are non-toxic and have a low viscosity, low melting point and high boiling point which are preferable requirements for thermal medium oils, however, they are still not satisfactory in oxidation stability.

The present inventors noted the alkylnaphthalene-based thermal medium oils and made intensive studies in attempts to develop or obtain alkylnaphthalene-based thermal medium oils having higher oxidation stability and, as the result of their studies, they found that thermal medium oils comprising at least one monosubstituted naphthalene derivative have remarkably high oxidation stability as compared with the known alkylnaphthalene-based ones. This invention is based on this finding or discovery.

OBJECT OF THE INVENTION

An object of this invention is to provide synthetic lubricating oils which are excellent particularly in oxidation stability.

This and other objects will be apparent from the following description.

CONSTRUCTION OF THE INVENTION

The thermal medium oil of this invention consists of, or comprises as the main component, at least one monosubstituted naphthalene derivative represented by the following general formula

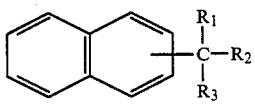

wherein $R_1$, $R_2$ and $R_3$ may be identical with, or different from, each other and are each an alkyl, phenyl or alkylphenyl group having 1 to 21 carbon atoms with the proviso that the total of carbon atoms of $R_1$, $R_2$ and $R_3$ is 4–23.

This invention will be explained hereunder in more detail.

The naphthalene derivative which makes up, or is comprised as the main component in, the thermal medium oil of this invention is required to be such that:

(1) the hydrocarbon radical is a monosubstituted naphthalene, (2) $R_1$, $R_2$ and $R_3$ of the hydrocarbon radical represented by the general formula

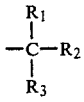

may be identical with, or different from, each other and are each an alkyl, phenyl or alkylphenyl group having 1 to 21 carbon atoms with the proviso that the total of carbon atoms of $R_1$, $R_2$ and $R_3$ is 4 to 23, and (3) the hydrocarbon radical is a tertiary one, i.e., it is attached directly to the naphthalene ring via a tertiary carbon atom. The above three requirements must be met for the purpose of this invention. Naphthalene derivatives which fail to meet even one of said three requirements are undesirable since they are inferior to those used in this invention in the respects of oxidation stability and other physical properties necessary as thermal media.

The monosubstituted naphthalene derivative used in this invention may be an $\alpha$-monosubstituted naphthalene derivative represented by the general formula

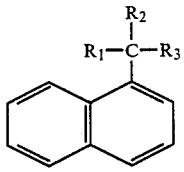

wherein $R_1$, $R_2$ and $R_3$ are as previously defined, or a $\beta$-monosubstituted naphthalene derivative represented by the general formula

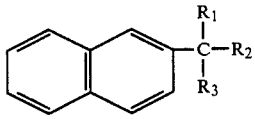

wherein $R_1$, $R_2$ and $R_3$ are as defined above. Of these two types of the derivatives, the $\beta$-monosubstituted naphthalene derivative is preferably used since it is easily available and stable as a chemical compound.

Further, $R_1$, $R_2$ and $R_3$ in the hydrocarbon radical represented by the general formula

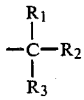

may be identical with, or different from, each other and are each an alkyl, phenyl or alkylphenyl group having 1 to 21 carbon atoms with the proviso that the total of carbon atoms of $R_1$, $R_2$ and $R_3$ is 4 to 23. In view of the physical properties of monosubstituted naphthalene derivative as a thermal medium oil, it is preferable that $R_1$, $R_2$ and $R_3$ be an alkyl, phenyl or alkylphenyl group having 1 to 15 carbon atoms and the total of carbon atoms thereof be 4 to 17. Further, in view of oxidation stability, it is preferred that $R_1$, $R_2$ and $R_3$ are each a straight-chain alkyl group.

The $R_1$, $R_2$ and $R_3$ in the general formula representing the monosubstituted naphthalene derivative used herein, include methyl, ethyl, propyl, butyl, pentyl, hexyl, heptyl, octyl, nonyl, decyl, undecyl, dodecyl, tridecyl, tetradecyl and pentadecyl groups, as well as phenyl, tolyl, xylyl, ethylphenyl, methylethylphenyl, diethylphenyl, propylphenyl, butylphenyl, pentylphenyl, hexylphenyl, heptylphenyl, octylphenyl and nonylphenyl groups. These groups are preferred.

It is particularly preferred that the $R_1$ and $R_2$ are each methyl or ethyl group and the $R_3$ is a straight-chain alkyl, phenyl or an alkylphenyl group having carbon atoms the number of which is such that the total of carbon atoms of the $R_1$, $R_2$ and $R_3$ is 4–17.

The preferable tertiary hydrocarbon radicals of the monosubstituted naphthalene derivatives used herein, the radicals being represented by the general formula

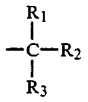

wherein $R_1$, $R_2$ and $R_3$ are as previously defined, include 1,1-dimethylpropyl(t.-amyl), 1-ethyl-1-methylpropyl, 1,1-dimethylbutyl, 1-ethyl-1-methylpropyl, 1,1-dimethylpentyl, 1,1-diethylpropyl, 1,1-dimethylhexyl, 1-ethyl-1-methylpentyl, 1,1-diethylbutyl, 1,1-dimethylheptyl, 1-ethyl-1-methylhexyl, 1,1-diethylpentyl, 1,1-dimethyloctyl, 1-ethyl-1-methylheptyl, 1,1-diethylhexyl, 1,1-dimethylnonyl, 1-ethyl-1-methyloctyl, 1,1-diethylheptyl, 1,1-dimethyldecyl, 1-ethyl-1-methylnonyl, 1,1-diethyloctyl, 1,1-dimethylundecyl, 1-ethyl-1-methyldecyl, 1,1-diethylnonyl, 1,1-dimethyldodecyl, 1-ethyl-1-methylundecyl, 1,1-diethyldecyl, 1,1-dimethyltridecyl, 1-ethyl-1-methyldodecyl, 1,1-diethylundecyl, 1,1-dimethyltetradecyl, 1-ethyl-1-methyltridecyl, 1,1-diethyldodecyl, 1,1-dimethylpentadecyl, 1-ethyl-1-methyltetradecyl, 1,1-diethyltridecyl, 1,1-dimethylhexadecyl, 1-ethyl-1-methylpentadecyl, 1,1-diethyltetradecyl, 1-methyl-1-phenylethyl ($\alpha,\alpha$-dimethylbenzyl), 1-methyl-1-phenylpropyl, 1-ethyl-1-phenylpropyl, 1-methyl-1-tolylethyl, 1-methyl-1-tolylpropyl, 1-ethyl-1-tolylpropyl, 1-methyl-1-xylylethyl, 1-methyl-1-xylylpropyl and 1-ethyl-1-xylylpropyl groups.

The monosubstituted naphthalene derivatives used in this invention may usually be synthesized by a Friedel-Crafts' alkylating reaction. More specifically, a tertiary halogenated hydrocarbon having 4 to 24 carbon atoms as the hydrocarbon source, an alcohol, a branched monoolefin having 4 to 24 carbon atoms and the double bond on the carbon atom of the branched chain, and an $\alpha$-alkylstyrene or the like, are used with naphthalene. Preferably, such a monoolefin and an $\alpha$-alkylstyrene or the like are reacted with naphthalene at a reaction temperature of 0°–250° C. in the presence of a metal halide catalyst such as aluminum chloride, zinc chloride or iron chloride, or an acid catalyst such as sulfuric acid, phosphoric acid, phosphorus pentoxide, fluoric acid, boron fluoride, acid clay or activated clay, to obtain the monosubstituted naphthalene derivative according to this invention. However, there are possibilities that such a Friedel-Crafts' alkylating reaction will disadvantageously cause the transition of carbon cation due to steric hindrance thereby to produce monosubstituted naphthalene derivatives having a secondary hydrocarbon radical in addition to those having a tertiary hydrocarbon radical. Thus, methods for producing monosubstituted naphthalene derivatives having a tertiary hydrocarbon radical only, include a method which comprises acylating naphthalene and then thoroughly methylating the thus acylated naphthalene, and a method which comprises substituting with halogen a hydrogen atom attached to a carbon atom positioned in the branched chain of a monosubstituted naphthalene derivative having a secondary hydrocarbon radical and then reacting the thus substituted product with a trialkyl aluminum.

In a case where there is synthesized a monosubstituted naphthalene derivative having a tertiary hydrocarbon radical by the aforesaid Friedel-Crafts' alkylating reaction, a $\beta$-monosubstituted naphthalene derivative will mainly be produced due to the effect of steric hindrance associated with the hydrogen atom at the 8th position of the naphthalene ring.

The thermal medium oil comprising the aforesaid monosubstituted naphthalene derivative has, per se, particularly excellent oxidation stability in addition to various properties required in ordinary thermal medium oils, and it may be incorporated, as required, with usually-used known additives for thermal medium oils such as an antioxidant, detergent dispersion, viscosity index improver, pour point depressant, oiliness improver, anti-wear agent, extreme pressure agent, anticorrosive agent, metal inactivating agent, antirust agent, antifoaming agent, emulsifier, demulsifier, bactericide, colorant and/or the like. The various additives mentioned above are described in detail in publications such as "Junkatsuyu Gakkai Shi (Journal of Japanese Society of Lubricating Oils)", vol. 15, No. 6 or "Seikyu Seihin Tenkazai (Additives for Petroleum Products)" edited by Toshio Sakurai and published by Sachi Shobo Book Store.

Further, the thermal medium oils of this invention may be incorporated, as required, with mineral oils and/or known lubricating oils in such amounts as not to impair their high oxidation stability. The mineral oils and/or known synthetic oils may be added in an amount by weight of up to 75%, preferably up to 50%, more preferably up to 25%.

PREFERRED EMBODIMENTS

This invention will be better understood by the following Examples and Comparative Examples wherein all parts are by weight unless otherwise specified.

Example 1

457 Parts of naphthalene were introduced into a four-necked flask, heated to 150° C. under agitation in a nitrogen atmosphere, incorporated with 80 parts of activated clay baked at 220° C. and then heated to 200° C., after which the mixture incorporated dropwise in small portions with 307 parts by $\alpha$-methylstyrene over a time period of 4 hours and kept at 200° C. under agitation for one hour to react the naphthalene with α-methylstyrene.

After completion of the reaction, the reaction mixture was cooled to 100° C. and filtered to obtain a filtrate which was then distilled under reduced pressure (1 mmHg) to obtain β-(α,α-dimethylbenzyl) naphthalene as the end product. The yield of this product was 82%, based on the α-methylstyrene. The thus obtained β-(α,α-dimethylbenzyl) naphthalene had the following properties:

Viscosity:
65.9 cSt at 40° C.
4.4 cSt at 100° C.
Pour point: −5° C.
Boiling point: 142° C. at 1.0 mmHg Example 2

Seven hundred (700) parts of naphthalene were introduced into a four-necked flask, heated to 150° C. under agitation in a nitrogen atmosphere and incorporated with 100 parts of activated clay baked at 220° C., after which the resulting mixture was incorporated dropwise in small portions with 500 parts of 2-methyl-1-nonene over a period of time of 4 hours and then kept at 200° C. under agitation for one hour to react the naphthalene with the 2-methyl-1-nonene.

After completion of the reaction, the reaction mixture was cooled to 100° C. and filtered to obtain a filtrate which was then distilled under reduced pressure (1 mmHg) to obtain β-(1,1-dimethyloctyl) naphthalene. The thus obtained naphthalene derivative had the following properties:

Viscosity: 14.86 cSt at 40° C.
Pour point: −45° C. or lower
Boiling point: 165° C./1 mmHg

EXAMPLE 3

The procedure of Example 2 was followed except that 2-methyl-1-heptene was substituted for the 2-methyl-1-nonene, thereby to obtain β-(1,1-dimethylhexyl) naphthalene having the following properties:

Viscosity: 10.65 cSt at 40° C.
Pour point: −45° C. or lower
Boiling point: 144° C./1 mmHg Example 4

The procedure of Example 2 was followed except that 2-methyl-1-undecene was substituted for the 2-methyl-1-nonene, thereby to obtain β-(1,1-dimethydecyl) naphthalene the properties of which are as indicated below.

Viscosity: 17.63 cSt at 40° C.
Pour point: −45° C. or lower
Boiling point: 185° C./1 mmHg Example 5

Naphthalene (1000 parts) was charged into a four-necked flask, heated to 150° C. under agitation in a nitrogen atmosphere, incorporated with 80 parts of activated clay baked at 220° C. and heated to 200° C., after which the resulting mixture was incorporated dropwise in small portions with 300 parts of 2-methyl-2-butene over a period of time of 4 hours and then kept at 200° C. under agitation for one hour to react the naphthalene with the 2-methyl-2-butene.

After the end of the reaction, the reaction mixture was cooled to 100° C. and filtered to obtain a filtrate which was distilled under reduced pressure (1 mmHg) to obtain β-t.-amylnaphthalene as the end product in a yield of 76%, based on the 2-methyl-2-butene. The thus obtained β-t.-amylnaphthalene had the following properties:

Viscosity:
5.2 cSt at 40° C.
1.5 cSt at 100° C.
Pour point: <−45° C.
Boiling point: 128° C. at 2.0 mmHg Comparative Examples 1-2

A naphthene-based refined mineral oil which has heretofore been known as a thermal medium oil, was incorporated with 1.0 wt.% of 2,6-di-t.-butyl-4-methylphenol to obtain a comparative thermal medium oil (Comparative Example 1). The thus obtained oil and diisopropylnaphthalene (Comparative Example 2) were used for comparison with the monosubstituted naphthalene derivatives of this invention (Examples 1-5).

Experiments (Oxidation tests on the end compounds of Examples 1-5 and Comparative Examples 1-2)

The end products of Examples 1-5 and Comparative Examples 1-2 were subjected to high-temperature oxidation tests using a test equipment prescribed in IP-280. The test conditions were as follows:

Test temperature: 170° C.
Flow of oxygen: 3 l/hr
Catalyst: Copper wire 1 mmϕ×80 cm.

The evaluation for oxidation stability was made by measuring how long each of the test compounds took to reach 1.0 mg KOH/g in acid value. The time so taken was assumed to be a service life at oxidation test. The results are as indicated in Table 1.

TABLE 1

| | Test compound | Service life at oxidation test (hr) |
|---|---|---|
| Example 1 | β-(α,α-dimethylbenzyl) naphthalene | 700.0 |
| Example 2 | β-(1,1-dimethyloctyl) naphthalene | 250.0 |
| Example 3 | β-(1,1-dimethylhexyl) naphthalene | 250.0 |
| Example 4 | β-(1,1-dimethyldecyl) naphthalene | 230.0 |
| Example 5 | β-t.-amylnaphthalene | 400.0 |
| Comp. Example 1 | Naphthene-based refined oil *1 | 8.0 |
| Comp. Example 2 | Diisopropylnaphthalene | 2.0 |

*1 Incorporated with 1.0 wt. % of 2,6-di-t.-butyl-4-methylphenol.

It is apparent from the results (service lives at oxidation test) that the thermal medium oils comprising the monosubstituted naphthalene derivative of this invention have very high oxidation stability, whereas the refined mineral oils, alkylnaphthalenes and the like which have heretofore been used as a thermal medium oil, are very inferior in service life to the compounds of this invention.

As is seen from the foregoing, the thermal medium oils comprising at least one monosubstituted naphthalene derivative of this invention have such high oxidation stability that conventional known mineral oil-based thermal medium oils and alkylnaphthalene-based thermal medium oils would not be able to attain.

What is claimed is:

1. A thermal medium oil consisting essentially of at least one monosubstituted naphthalene of formula

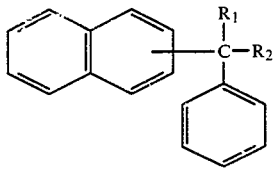
wherein $R_1$ and $R_2$ are the same, or different and are each methyl or ethyl.
2. A thermal medium oil according to claim 1, wherein said monosubstituted naphthalene is beta-monosubstituted naphthalene of formula
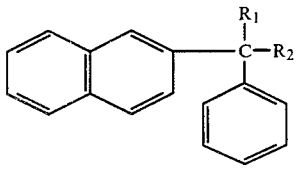
wherein $R_1$ and $R_2$ are the same, or different and are each methyl or ethyl.
* * * * *